US006942028B2

(12) United States Patent
Hosie

(10) Patent No.: US 6,942,028 B2
(45) Date of Patent: Sep. 13, 2005

(54) SLIM-BORE TUBING HANGER

(75) Inventor: Stanley Hosie, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 180 days.

(21) Appl. No.: 10/353,561

(22) Filed: Jan. 29, 2003

(65) Prior Publication Data

US 2003/0141071 A1 Jul. 31, 2003

Related U.S. Application Data

(60) Provisional application No. 06/353,072, filed on Jan. 30, 2002.

(51) Int. Cl.[7] ..... E21B 33/04; E21B 34/10

(52) U.S. Cl. ..... 166/88.4

(58) Field of Search ..... 166/348, 368, 166/88.1, 89.1, 88.4

(56) References Cited

U.S. PATENT DOCUMENTS 3,739,846 A * 6/1973 Beson ..... 166/89.2
4,491,176 A * 1/1985 Reed ..... 166/66.4
5,465,794 A 11/1995 McConaughy et al.
5,865,250 A * 2/1999 Gariepy ..... 166/375
6,053,252 A 4/2000 Edwards
6,102,124 A 8/2000 Skeels et al.
6,227,300 B1 5/2001 Cunningham et al.
6,244,348 B1 6/2001 Gariepy et al.
6,470,971 B1 10/2002 Bridges
6,557,638 B2 * 5/2003 Cunningham et al. ..... 166/348
6,598,680 B2 * 7/2003 DeBerry ..... 166/368
6,763,891 B2 * 7/2004 Humphrey et al. ..... 166/368

FOREIGN PATENT DOCUMENTS

GB 2351310 A 12/2000

* cited by examiner

*Primary Examiner*—Sunil Singh
(74) *Attorney, Agent, or Firm*—Bracewell & Giuliani LLP

(57) ABSTRACT

A subsea wellhead assembly has a wellhead housing at the upper end of the well. The wellhead housing supports one or more strings of casing, each having a casing hanger. A tubing spool connects to the upper end of the wellhead housing. The tubing spool has a landing shoulder with a plurality of auxiliary passages extending from the shoulder to the exterior of the tubing spool. The auxiliary passages are spaced circumferentially around the tubing spool. A receptacle on the exterior of the tubing spool communicates with these auxiliary passages. A tubing hanger lands in the tubing spool, the tubing hanger having auxiliary ports spaced circumferentially around it. These ports mate with the auxiliary passages to communicate with auxiliary lines extending alongside the tubing. A production tree mounts to the upper end of the tubing spool. A control unit mounted to the production tree assembly has a flexible lead that extend from it and plugs into the receptacle.

16 Claims, 2 Drawing Sheets

SLIM-BORE TUBING HANGER

This application claims the provisional application filing date of Jan. 30, 2002, Ser. No. 60/353,072 entitled "Slim-Bore Tubing Hanger".

FIELD OF THE INVENTION

This invention relates in general to subsea wellhead assemblies, and in particular to a subsea wellhead assembly that locates a tubing hanger in a tubing spool between a production tree and the wellhead housing.

BACKGROUND OF THE INVENTION

One type of subsea wellhead assembly has a wellhead housing located at the upper end of the well. One or more strings of casing are supported by casing hangers in the wellhead housing. In a conventional subsea wellhead assembly, a tubing hanger secured to a string of tubing lands in the wellhead housing above the casing hanger. The tubing hanger typically has a plurality of vertical auxiliary passages that surround a vertical bore. The auxiliary passages provide penetration access through the tubing hanger for hydraulic and electrical components located downhole. Electrical and hydraulic lines extend alongside of the tubing to control downhole valves, temperature sensors and the like. The tubing hanger also has a tubing annulus passage that is offset and parallel to the bore for communicating with the tubing annulus.

A production tree lands on top of the wellhead housing. The production tree has a vertical bore that receives upward flow from the tubing hanger. The tree has valves and typically a choke for controlling flow from the well. The vertical auxiliary passages in the tubing hanger mate with auxiliary connectors protruding from the base of the tree. Auxiliary passages in the tree lead to a control unit that is mounted to the tree assembly.

One disadvantage of the conventional type of subsea wellhead assembly is that the tubing hanger must have a fairly large diameter because of the number of vertical passages extending through it. A large diameter tubing hanger requires a large diameter drilling riser through which the tubing hanger must be run prior installing the tree.

In another type of tree, often referred to as a "horizontal tree", the tubing hanger lands in the tree after the tree has been installed, rather than landing in the wellhead housing. This tubing hanger has a vertical central bore, but does not have a tubing annulus passage extending through it. A lateral outlet in the tubing hanger extends from the central bore for production flow. Also, it normally does not have vertical auxiliary passages extending through it, thus may be smaller in diameter than a tubing hanger for a conventional tree. One type of horizontal tree tubing hanger has auxiliary passages that extend through the lower portion to a lower convex annular shoulder. The shoulder of the tubing hanger mates with a concave shoulder formed in the bore of the tree. Auxiliary passages extend through the tree and register with the auxiliary ports of the tubing hanger.

SUMMARY OF THE INVENTION

The subsea wellhead assembly of this invention has a tubular housing assembly and at least one casing hanger that lands therein to support a string of casing. A plurality of auxiliary passages extend through and are spaced circumferentially around the housing assembly. A tubing hanger lands in the housing assembly for supporting a string of tubing. The tubing hanger has a plurality of auxiliary ports spaced around it that mate with the auxiliary passages of the housing assembly to communicate the auxiliary passages with auxiliary lines extending down alongside the tubing from the tubing hanger. A production tree mounts to the upper end of the housing assembly for receiving and controlling well fluids flowing upward from the tubing hanger.

Additionally, a receptacle is preferably mounted on the exterior of the housing assembly in communication with the auxiliary passages. A control unit is mounted to the tree assembly for controlling electrical and hydraulic functions of the tree assembly. A flexible lead extends from the control unit, the flexible lead having a plug that stabs into the receptacle for communicating the control unit with the auxiliary lines. The flexible lead is preferably connected to the receptacle by a remote operated vehicle (ROV).

In the preferred embodiment, the auxiliary passages extending through the housing assembly terminate at a concave shoulder formed in the bore of the housing assembly. The tubing hanger has a convex mating surface that lands on the shoulder. The auxiliary ports in the tubing hanger terminate at the convex landing surface. Also, in the preferred embodiment, the housing assembly comprises two components, a wellhead housing in which the casing lands and a tubing spool mounted on top of the wellhead housing. The tubing hanger lands in the tubing spool.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1A:
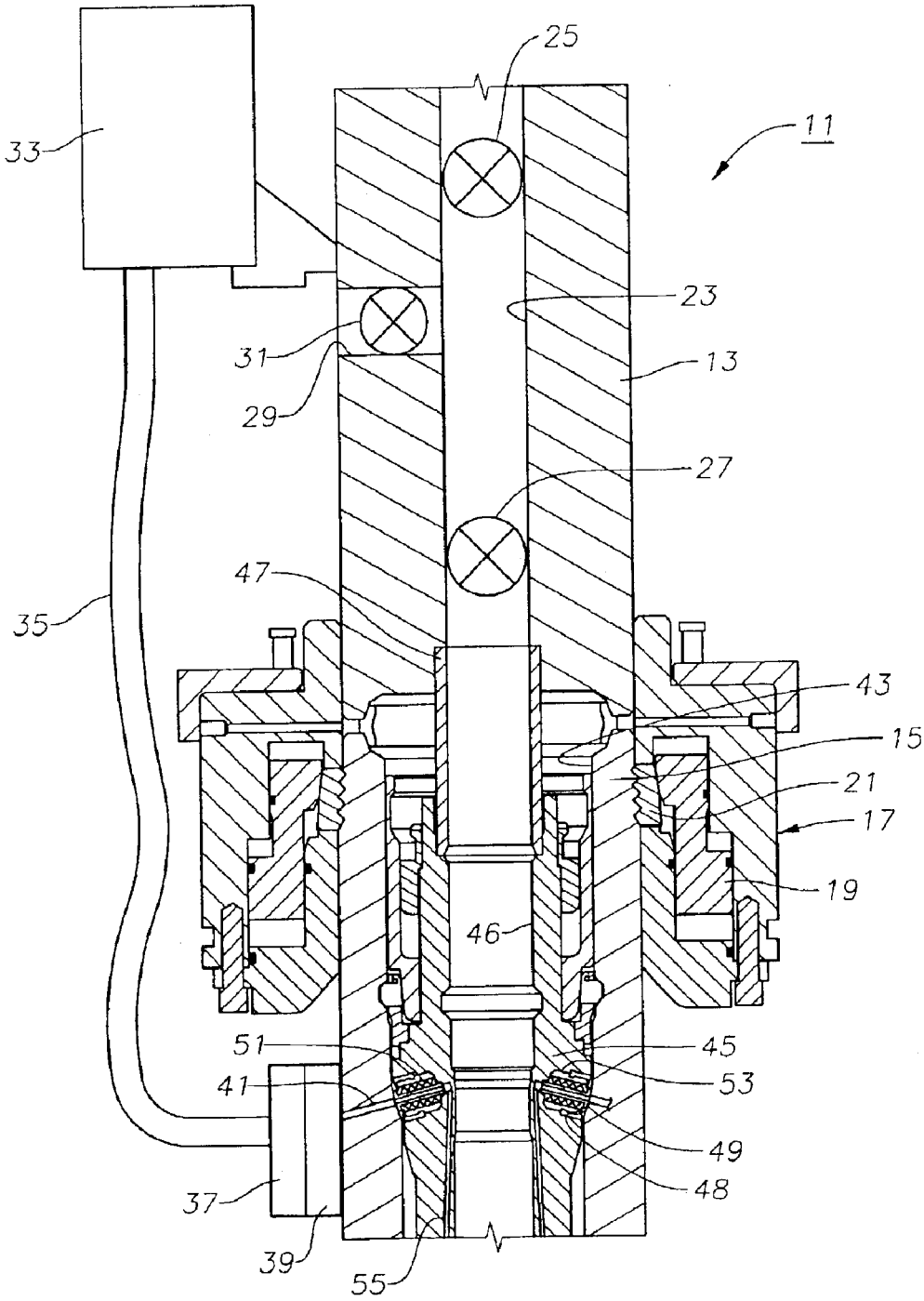
FIG. 1A is a cross-sectional view of an upper portion of a wellhead assembly constructed in accordance with the present invention.

Referring to FIG. 1A, wellhead assembly 11 comprises a conventional christmas or production tree 13 mounted to the upper end of a tubing spool 15 using connector 17. Tubing spool 15 is a cylindrical tubular member. Connector 17 has an annular piston 19 that moves vertically to selectively cause a plurality of lock members 21 to engage a grooved profile on the exterior of spool 15. When piston 19 is in the upper position, lock members 21 are disengaged from the profile on spool 15. When piston 19 is moved downward, lock members 21 are cammed inward to engage the profile. Tree 13 has a vertical bore 23, and production valves 25, 27 are located in bore 23. Tree 13 also has a horizontal production passage 29 extending from bore 23 and containing valve 31.

A control pod 33 is mounted to the exterior of tree 13. Control pod 33 contains controls and connections for providing electrical signals and hydraulic pressure for tree 13 during well operations. A flying lead 35 extends from control pod 33 to stab plate 37, stab plate 37 being stabbed into receptacle 39 on spool 15. Alternatively, a stab plate on a separate flying lead (not shown) extending from the riser assembly may be connected to receptacle 39, depending on the mode of operation of wellhead assembly 11. A plurality of internal auxiliary passages 41 (only two shown) communicate bore 43 of spool 15 with receptacle 39. Passages 41 are spaced circumferentially apart from each other and terminate preferably on a spherical concave landing shoulder 48 in bore 43 of spool 15.

Figure 1B:
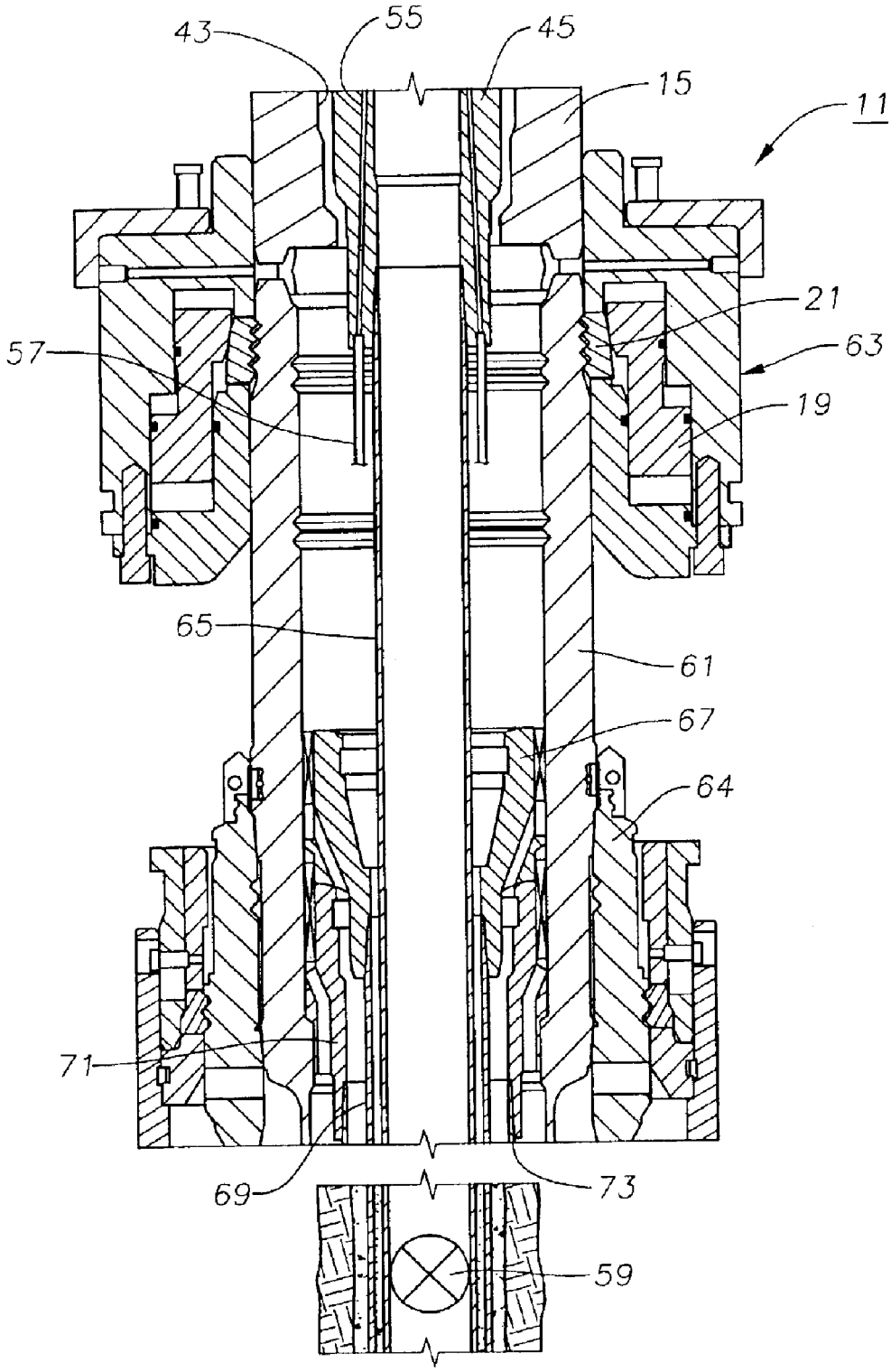
FIG. 1B is a cross-sectional view of a lower portion of a wellhead assembly constructed in accordance with the present invention.

A tubing hanger 45 is shown landed in spool 15. Tubing hanger 45 has a bore 46 and an outer diameter that is preferably 13 ⅝ inches or less, allowing for use of hanger 45 in typical wellhead installations. A tubular stinger or insert 47 connects bore 46 to bore 23 of tree 13. Shoulder 48 is engaged by a downward-facing spherical shoulder 49 on the exterior of tubing hanger 45. Seals 51 are mounted in ports 53, which are located in shoulder 49 and are inclined to be normal to shoulders 48, 49. Seals 51 are spring-biased toward an outer position, seals 51 contacting shoulder 48 when tubing hanger 45 is landed in spool 15. Auxiliary ports 53, each of which is sealed by one of the seals 51, communicate with auxiliary passages 41 in tubing spool 15. Each auxiliary port 53 leads to an internal, vertical auxiliary passages 55 within tubing hanger 45. Auxiliary passages 55 extend to auxiliary lines 57, lines 57 extending downhole to provide fluid pressure for operating various devices, including safety valve 59 (FIG. 1B). Hydraulic pressure in lines 57 maintains safety valve 59 in an open position.

The lower end of spool 15 is mounted by connector 63 to the upper end of a high-pressure or inner wellhead housing 61. Connector 63 is constructed and operates like connector 17, described above. Inner wellhead housing 61 is mounted within outer wellhead housing 64, which is secured to the sea floor. Production tubing 65 is suspended from the lower portion of tubing hanger 45. Access to the tubing annulus surrounding tubing 65 may be through a port (not shown) in tubing spool 15 below spherical shoulders 48, 49.

Tubing 65 extends through a casing hanger 67, which is landed in inner wellhead housing 61. Casing 69 is secured to the lower end of casing hanger 67 and extends downward into the well. A second casing hanger 71 optionally may be landed within inner wellhead housing 61 for supporting an additional, concentric string of outer casing 73.

Tubing hanger 45 preferably has guide means (not shown) for rotationally orienting hanger 45 within spool 15 to align ports 53 and passages 41. For example, an orienting sleeve may depend from hanger 45 for engaging casing hanger 67 or other components in spool 15 or inner wellhead housing 61.

To assemble wellhead assembly 11, outer wellhead housing 64 is installed at a subsea well, and inner wellhead housing 61 is mounted within the upper end of housing 64. Outer casing 73 is then lowered into the well, and the upper end of casing 73 is secured to the lower end of casing hanger 71 prior to casing hanger 71 landing in inner wellhead housing 61. Casing 69 is lowered into the well within casing 73, the lower end of casing hanger 67 is secured to the upper end of casing 69, and casing hanger 67 is landed in inner wellhead housing 61 above casing hanger 71.

The upper portion of wellhead assembly 11 is assembled by lowering spool 15 and connector 63 onto the upper end of inner wellhead housing 61. Piston 19 of connector 63 is then moved downward to cause lock members 21 to engage the grooved profile on the exterior of housing 61. Tubing 65 is lowered into the well through spool 15 and casing hangers 67, 71 and within casing 69. Tubing 65 is secured to the lower end of tubing hanger 45, and hanger 45 is landed in bore 43 of spool 15. Seals 51 engage shoulder 48, compressing seals 51 and ensuring a proper seal. Ports 53 align with passages 41 to provide a path for fluid pressure to pass into tubing hanger 45.

Christmas tree 13, connector 17, control pod 33, and insert 47 are lowered into position at the upper end of spool 15, and connector 63 is manipulated as described above for connector 63 to cause lock members 21 to engage the grooved profile on the exterior of spool 15. Stab plate 37 on flying lead 35 is then attached to receptacle 39 by a remotely-operated vehicle.

In operation, control pod 33 provides electrical signals and hydraulic pressure to wellhead assembly 11 for controlling various components. Hydraulic pressure is supplied through flying lead 35 to stab plate 37, then into receptacle 37 and through passage 41 of spool 15. Seals 51 sealingly connect ports 53 of tubing hanger 45 to passages 41. The hydraulic pressure then travels through passages 55 and lines 57 to a downhole location to operate, for example, safety valve 59. Well fluid flows upward through tubing 65 and tubing hanger 45, then into tree 13. The well fluid flows out of production passage 29. In situations when workover operations are needed, vertical access is provided through tree bore 23 and tubing hanger bore 46.

Several advantages are realized by the use of the present invention. A slim-bore tubing hanger as described can be used in a conventional tree installation, the tubing hanger maximizing the number of downhole passages for carrying hydraulic pressure. The ports are located below the running-tool and locking profiles, and seals in the ports provide for easy make-up of the communication paths during assembly.

While the invention has been shown or described in only one of its forms, it should be apparent to those skilled in the art that it is not so limited, but is susceptible to various changes without departing from the scope of the invention.

I claim:

1. A subsea wellhead assembly, comprising:

an outer wellhead housing;

an inner wellhead housing landed in and extending above the outer wellhead housing;

tubing spool connected to an upper end of the inner wellhead housing;

a casing hanger landed in the inner wellhead housing for supporting a string of casing;

a plurality of auxiliary passages extending through and spaced circumferentially around the tubing spool;

a tubing hanger landed in the tubing spool for supporting a string of tubing;

a plurality of auxiliary ports spaced circumferentially around the tubing hanger that mate with the auxiliary passages for communicating the auxiliary passages with auxiliary lines extending downward alongside the tubing from the tubing hanger; and a production tree assembly mounted to an upper end of the tubing spool for receiving and controlling well fluids flowing upward from the tubing hanger.

2. The wellhead assembly according to claim 1, further comprising:

a receptacle mounted on a side wall of the tubing spool in communication with the auxiliary passages;

a control unit mounted adjacent to the tubing spool for controlling electrical and hydraulic functions of the tree assembly; and a flexible lead extending from the control unit and having a plug that connects to the receptacle for communicating the control unit with the auxiliary lines.

3. The wellhead assembly according to claim 2, wherein the plug of the flexible lead is ROV deployable into plugging engagement with the receptacle.

4. The wellhead assembly according to claim 1, further comprising:

a landing shoulder in the tubing spool onto which the tubing hanger lands; and wherein the auxiliary passages extend through the landing shoulder normal to the landing shoulder.

5. The wellhead assembly according to claim 1, further comprising:

a concave shoulder in the tubing spool;

a mating convex surface on the tubing hanger; and wherein the auxiliary passages terminate at the concave shoulder, and the auxiliary ports terminate at the mating convex surface.

6. The wellhead assembly according to claim 1, further comprising an isolation tube on a lower end of the tree assembly that stabs into an upper end of the tubing hanger for communicating well fluid from the tubing to the tree assembly.

7. The wellhead assembly according to claim 1, wherein each of the auxiliary passages in the tubing spool is free of any structure that protrudes inward into engagement with one of the auxiliary ports in the tubing hanger, so that mating engagement of the auxiliary passages and auxiliary ports occurs automatically upon landing of the tubing hanger in the tubing spool.

8. A subsea wellhead assembly, comprising:

an outer wellhead housing for placement at an upper end of a well;

an inner wellhead housing landed in and extending from the outer wellhead housing;

a tubing spool connected to an upper end of the outer wellhead housing, the tubing spool having a landing shoulder, a plurality of auxiliary passages extending through and spaced circumferentially around the tubing spool;

a receptacle on an exterior of the tubing spool in communication with the auxiliary passages;

a tubing hanger landed on the shoulder in the tubing spool for supporting a string of tubing;

a plurality of auxiliary ports spaced circumferentially around the tubing hanger that mate with the auxiliary passages for communicating with auxiliary lines extending downward alongside the tubing from the tubing hanger;

a production tree assembly mounted to an upper end of the tubing spool for receiving well fluids flowing upward through the tubing hanger;

a control unit mounted adjacent to the tubing spool for controlling electrical and hydraulic functions of the tree assembly; and a flexible lead extending from the control unit for communicating the control unit with the auxiliary lines and having an ROV deployable plug that connects to the receptacle.

9. The wellhead assembly according to claim 8, wherein the shoulder in the tubing hanger is a concave surface, and the tubing hanger has a mating convex surface.

10. The wellhead assembly according to claim 8, wherein the auxiliary passages terminate at the shoulder in the tubing spool.

11. The wellhead assembly according to claim 8, wherein the control unit is mounted to the tree assembly.

12. The wellhead assembly according to claim 8, wherein the auxiliary passages fully and sealingly mate with the auxiliary ports without requiring any structure extending from the auxiliary passages into the auxiliary ports.

13. A method of completing and producing a subsea well, comprising:

providing a tubular outer wellhead housing at an upper end of the well, an inner wellhead housing landed in and protruding from the outer wellhead housing, and a tubing spool mounted to an upper end of the inner wellhead housing, the tubing spool having a plurality of auxiliary passages extending through and spaced circumferentially around the tubing spool;

securing a tubing hanger to a string of tubing, the tubing hanger having a plurality of auxiliary ports spaced circumferentially around the tubing hanger that are in communication with auxiliary lines extending alongside the string of tubing;

landing the tubing hanger in the tubing spool and mating the auxiliary ports with the auxiliary passages, thereby communicating the auxiliary passages with the auxiliary lines; and landing a production tree assembly on an upper end of the tubing spool and receiving well fluids flowing upward from the tubing hanger.

14. The method according to claim 13, further comprising:

mounting a receptacle on an exterior of the tubing spool in communication with the auxiliary passages;

mounting a control unit adjacent to the tubing spool, and providing the control unit with a flexible lead having a plug; then after the tree has landed on the upper end of the tubing spool, connecting the plug with the receptacle.

15. The method according to claim 14, wherein the flexible lead is connected to the receptacle with the assistance of an ROV.

16. The method according to claim 14, wherein mating the auxiliary ports of the tubing hanger with the auxiliary passages of the tubing spool occurs automatically upon landing of the tubing hanger in the tubing spool.

* * * * *